US010121572B2

(12) United States Patent
Koeppendoerfer

(10) Patent No.: US 10,121,572 B2
(45) Date of Patent: Nov. 6, 2018

(54) DATA CABLE, DATA TRANSMISSION METHOD, AND METHOD FOR PRODUCING A DATA CABLE

(71) Applicant: LEONI KABEL GMBH, Nuremberg (DE)

(72) Inventor: Erwin Koeppendoerfer, Schwabach (DE)

(73) Assignee: LEONI Kabel GmbH, Nuremberg (DE)

( * ) Notice: Subject to any disclaimer, the term of this patent is extended or adjusted under 35 U.S.C. 154(b) by 0 days.

(21) Appl. No.: 15/593,619

(22) Filed: May 12, 2017

(65) Prior Publication Data

US 2017/0250009 A1 Aug. 31, 2017

Related U.S. Application Data

(63) Continuation of application No. PCT/EP2015/076231, filed on Nov. 10, 2015.

(30) Foreign Application Priority Data

Nov. 12, 2014 (DE) ..... 10 2014 223 119

(51) Int. Cl.

| | |
|---|---|
| ***H01B 7/00*** | (2006.01) |
| ***H01B 11/10*** | (2006.01) |
| ***H01B 11/00*** | (2006.01) |
| ***H01B 13/22*** | (2006.01) |

(52) U.S. Cl.
CPC ..... *H01B 11/10* (2013.01); *H01B 11/002* (2013.01); *H01B 13/22* (2013.01)

(58) Field of Classification Search
CPC ... H01B 7/00; H01B 7/02; H01B 7/04; H01B 9/02; H01B 9/18; H01B 13/02
USPC ..... 174/110 R, 113 R, 113 C, 115, 116, 174/120 R
See application file for complete search history.

(56) References Cited

U.S. PATENT DOCUMENTS

| | | | | |
|---|---|---|---|---|
| 5,952,615 | A | 9/1999 | Prudhon | |
| 6,010,788 | A * | 1/2000 | Kebabjian | H01B 11/002 174/102 R |
| 6,288,340 | B1 * | 9/2001 | Arnould | H01B 11/085 174/113 R |
| 6,310,295 | B1 | 10/2001 | Despard | |

(Continued)

FOREIGN PATENT DOCUMENTS

| | | |
|---|---|---|
| DE | 4440507 A1 | 5/1996 |
| DE | 19948678 A1 | 5/2001 |

(Continued)

*Primary Examiner* — William H Mayo, III
(74) *Attorney, Agent, or Firm* — Laurence A. Greenberg; Werner H. Stemer; Ralph E. Locher

(57) ABSTRACT

A data cable, which is particularly suitable for the automotive industry and for transmission frequencies in the gigahertz range. The data cable has two wire pairs which each have two wires which are surrounded by a pair shield. In addition to the pair shield, a planar or flat shielding element which does not surround the core pairs and makes contact with the two pair shields is arranged between the wires. The shielding element has, in particular, individual wires which run next to one another. Contact can be made with the pair shield in a plug region in a simple manner by way of the shielding element.

18 Claims, 2 Drawing Sheets

(56) References Cited

U.S. PATENT DOCUMENTS 6,403,887 B1 * 6/2002 Kebabjian ..... H01B 11/002 174/110 R
6,686,537 B1 * 2/2004 Gareis ..... H01B 7/292 174/110 R
6,825,419 B2 * 11/2004 Grogl ..... H01B 7/041 174/102 C
7,449,639 B2 * 11/2008 Nair ..... H01B 7/0876 174/113 R
7,465,879 B2 * 12/2008 Glew ..... H01B 7/0892 174/113 C
7,790,981 B2 * 9/2010 Vaupotic ..... H01B 11/1008 174/113 R
7,834,271 B2 * 11/2010 Gromko ..... H01B 11/085 174/113 AS
7,999,185 B2 * 8/2011 Cases ..... H01B 11/203 174/113 R
8,563,865 B2 * 10/2013 Nair ..... H01B 7/0876 174/113 R
8,569,627 B1 * 10/2013 Salz ..... H01B 7/0892 174/102 R
2003/0106704 A1 * 6/2003 Isley ..... H01B 11/04 174/113 R
2008/0105449 A1 * 5/2008 Kenny ..... H01B 7/0233 174/34
2008/0173465 A1 * 7/2008 Nair ..... H01B 7/0876 174/117 FF
2009/0236121 A1 * 9/2009 Hopkinson ..... H01B 11/002 174/113 R
2009/0260847 A1 10/2009 Tobben et al.
2010/0025072 A1 * 2/2010 Okano ..... H01B 11/1008 174/115
2010/0181093 A1 * 7/2010 Wiekhorst ..... H01B 7/184 174/113 R
2011/0168423 A1 7/2011 Hagi et al.
2012/0080210 A1 * 4/2012 Camp, II ..... H01B 11/06 174/34
2012/0080211 A1 * 4/2012 Brown ..... H01B 11/06 174/34
2012/0267142 A1 * 10/2012 Nordin ..... H01B 11/1008 174/102 R
2013/0008684 A1 1/2013 Weitzel et al.
2013/0248221 A1 * 9/2013 Booth ..... H01B 7/189 174/103
2014/0060913 A1 * 3/2014 Hopkinson ..... H01B 11/06 174/350
2014/0102756 A1 * 4/2014 Ishikawa ..... H01B 11/1895 174/115
2014/0262411 A1 * 9/2014 Hopkinson ..... H01B 11/085 174/34
2015/0008011 A1 * 1/2015 Koeppendoerfer .. H01B 7/0009 174/113 R

FOREIGN PATENT DOCUMENTS

DE 10315609 A1 10/2004
DE 102008019968 A1 10/2009
DE 102012204554 A1 9/2013
WO 0051142 A1 8/2000

* cited by examiner

DATA CABLE, DATA TRANSMISSION METHOD, AND METHOD FOR PRODUCING A DATA CABLE

CROSS-REFERENCE TO RELATED APPLICATION

This application is a continuation, under 35 U.S.C. § 120, of copending international patent application No. PCT/EP2015/076231, filed Nov. 10, 2015, which designated the United States; this application also claims the priority, under 35 U.S.C. § 119, of German patent application No. DE 10 2014 223 119.1, filed Nov. 12, 2014; the prior applications are herewith incorporated by reference in their entirety.

BACKGROUND OF THE INVENTION

Field of the Invention

The invention relates to a data cable having two wire pairs that comprise in each case two wires that are surrounded by a pair shielding. The invention further relates to a method for producing a data cable of this type.

Data cables of this type having shielded wire pairs are used as so-called high speed data cables (HSD) by way of example for transmission purposes in computer networks. The data cables are embodied so as to transmit frequencies typically in the range of several 100 MHz up to in the GHz range.

In so doing, the data are usually transmitted in a digital manner, wherein the data signal is supplied to one wire and the inverted data signal is supplied to the other wire. In the automotive industry, the LVDS (low voltage digital signaling) standard that is based on this principle is mainly used.

A data cable of this type is disclosed, by way of example, in German published patent application DE 199 48 678 A1. In the case of the data cable described in said document, a respective wire pair is embodied as one piece and comprises a common wire insulation for the two wires and comprises for this purpose an interconnecting intermediate connecting piece between the two wires. As a result of this feature, the two wires are held together in a reliable manner at a defined spacing which is of advantage for a good data transmission.

In the case of wire pairs that are provided with pair shieldings, it is usual to arrange a so-called filler wire that makes contact with the pair shielding and is provided in particular at the end of the cable in the region of a plug connector so as to make electrical contact with the shield at the plug connector. Commonly assigned patent publication US 2009/0260847 A1 and its counterpart German published patent application DE 10 2008 019 968 A1 disclose a data cable of this type. In that device, a filler wire makes contact with one pair shielding.

Generally, data cables of this type comprise an outer shield that totally surrounds the entire cable core that comprises the individual wires, wherein this outer shielding is surrounded in turn typically by an outer cable sheath. An outer shielding of this type is frequently embodied as a braided shield or also with multiple layers having a braided shield and further shielding foils.

High speed data cables that meet the strictest demands are marketed by the applicant under the trademark PARA-LINK®.

In application areas where the technical requirements are less strict, data cables that comprise a so-called quad stranding, in particular with a star-quad design, are used. In the case of star-quads of this type, two wires that are in each case diagonally opposite one another form a wire pair. In the case of star-quad data cable of this type, problems arise with the so-called near-end crosstalk (NEXT) in the case of higher signal frequencies, in particular in the GHz range and especially in the case of longer cable lengths in excess of multiple meters. Owing to the problem of near-end crosstalk, the individual wires are in addition usually twisted with one another (so-called pair stranding) even in the case of non-quad stranded pairs. This generally requires a precise, highly accurate symmetry of the manner in which the individual wires are stranded.

In addition to the problem of the near-end crosstalk, the problem of having to attenuate said near-end crosstalk also determines the quality of the transmission. This is influenced by interference inside the cables.

Commonly assigned patent application US 2015/0008011 A1 and its counterpart German published patent application DE 10 2012 204 554 A1 disclose a further high speed data cable, wherein in order to avoid or at least reduce the so-called return loss it is proposed in the case of the conductors to use a stranded wire of a varying length of lay for a respective wire.

In order to achieve a good signal transmission, it is necessary fundamentally necessary to have sufficient interference spacing between the actual useful signal and a possible interference signal, by way of example caused by the near-end crosstalk. This interference spacing is characterized by way of example by means of the so-called ACR value (attenuation to crosstalk ratio).

In order to improve the shielding effect and to avoid or reduce the near-end crosstalk between adjacent wire pairs, it is evident by way of example from the publications U.S. Pat. No. 5,952,615, US 2013/0008684 A1 or U.S. Pat. No. 6,310,295 B1 to use separators that, when viewed in the cross-section, are star-shaped. Said separators comprise by way of example a synthetic material strand which is provided with a conductive coating for a shielding effect or are formed by means of a shielding foil that is folded to form a hollow body.

Star-quad data cables are used nowadays in the automotive industry in particular owing to their cost advantage. In the case of said cables, four wires are stranded with one another, wherein the respective diagonally opposite wires form a respective wire pair by way of which in particular a differential data signal is transmitted. In the future, data cables are to be used with signal frequencies in the GHz range which cannot be readily achieved with the conventional star-quad connection. It is usually not possible owing to high costs to use high-end data cables as known in computer networks.

SUMMARY OF THE INVENTION

It is accordingly an object of the invention to provide a data cable and a production method which overcome the above-mentioned and other disadvantages of the heretofore-known devices and methods of this general type and which provide a high speed data cable, in particular for signal frequencies up to the GHz range, and a data cable that renders it possible to achieve a reliable signal transmission while simultaneously being cost-effective to produce so that it is also suitable in particular for use in the automotive industry.

With the foregoing and other objects in view there is provided, in accordance with the invention, a data cable, comprising:

two wire pairs each including two wires;

a pair shielding surrounding each of the two wire pairs;

a planar shielding element disposed between the wire pairs and not encompassing the wire pairs, the planar shielding element making contact with each of the pair shieldings.

In other words, the data cable comprises two wire pairs that include in each case two wires. The two wires of one wire pair are surrounded in each case by a pair shielding. In addition to this pair shielding, a shielding element is now arranged in addition between the shielded wire pair and said shielding element is embodied in a planar manner and does not encompass the wire pairs. The two pair shieldings are contacted simultaneously by way of the shielding element.

The planar shielding element is therefore arranged as a type of separating layer or intermediate layer between the two shielded wire pairs and is in particular clamped between said wire pairs and therefore held by said wire pairs. Said planar shielding element is embodied merely as a ribbon-shaped planar element without it surrounding an inner space as is the case with conventional shields that surround a wire construction by way of example by means of being spun, or folded, wound etc. around said wire construction. The planar element itself also does not comprise in particular any hollow spaces or the like. When viewed in the cross-section, the shielding element is therefore merely embodied in a linear shape without encompassing an intermediate space. The planar shielding element is in particular embodied so as to be (bendable) flexible and does not comprise any intrinsic rigidity. The shielding element extends along the wire pairs as a planar intermediate strip or separating strip over the entire length of the data cable.

The additional shielding element provides the particular advantage of an additional shielding affect between the two wire pairs so that—by way of example in comparison to a star-quad connection—the problem of near-end crosstalk is eliminated. Simultaneously, it is consequently possible to forego a quad stranding. A pair stranding, in other words a twisting of the wires of the wire pair, is preferably omitted so that the required entire length in comparison to twisted wires is shortened which leads to a saving in materials used and thus a reduction in weight and costs. A further advantage is to be found in the fact that, in comparison to conventional high-speed data transmission cables having pair shieldings, the pair shieldings are reliably contacted in a plug connection region by a ground contact and said contact can be achieved in a simple manner by way of the additional shielding element. It is fundamentally difficult to make contact with a pair shielding during the production process. Simultaneously, an additional arrangement of a filler wire is preferably omitted by virtue of the shielding element.

A construction of this type is suitable for reliably transmitting signals up to in the GHz range, by way of example up to at least approximately 10 GHz. Simultaneously, this construction is also suitable for use as data transmission cables in the automotive industry and is used in particular in said industry. By virtue of the additionally provided shielding foil, the outlay with regard to the shielding can be reduced overall in comparison to conventional data cables and this has a positive effect in relation to cost-effective production.

In an expedient embodiment, the shielding element is formed by means of single individual wires that extend adjacent to one another. Said wires are embodied in particular as copper wires. The wires are preferably arranged lying adjacent to one another and in other words are preferably not braided or twisted with one another. They form in particular a single layer of individual wires. As an alternative thereto, a few layers, by way of example two to three layers, of individual wires can also be configured.

It is preferred that these individual wires are the individual wires of a conductor comprising strands that are splayed out. This embodiment is particularly simple to implement with regard to the production technology. In order to produce the data cable that is typically produced in a continuous process, the stranded conductor is supplied parallel with the other components of the data cable and is only splayed out, in other words twisted open, so as to form the shielding element so that the individual wires are arranged adjacent to one another as a flat bundle of conductors and form a planar shielding element that has by way of example a rectangular cross-section. This embodiment of the shielding element renders it possible in addition also to make a particularly simple contact in the plug connector region with a ground contact since the individual wires can be brought back together in a simple manner and can make contact with the conventional wire or conductor contacting arrangements. As a consequence, it is therefore possible overall to also produce a data cable in a simple manner with a plug connector that is provided at one end. It is namely fundamentally considerably simpler to make contact with a wire bundle of this type, in particular comprising individual copper wires, than to make contact with a foil shielding as is usually used for the pair shielding.

As an alternative or in addition to this shielding formed by means of a bundle of splayed out wires, the shielding element comprises a shielding foil. This shielding foil is in particular embodied so as to reduce the effects of interference in the low frequency range. This is based on the consideration that the pair shielding used is typically only slightly effective in the low frequency range by way of example of a few MHz so that therefore near-end crosstalk can occur in the low frequency range. Said near-end crosstalk usually does not pose a particular problem in the low frequency range for the quality of the data transmission since, although the NEXT near-end crosstalk does create interference, there is simultaneously no attenuation or rather only low attenuation in the low frequency range so that the interference spacing between the useful signal and the interference signal is sufficiently large so as to allow a reliable data transmission. The ratio between the attenuation and near-end crosstalk, the so-called ACR value (attenuation to crosstalk ratio) therefore continues to be sufficient.

In an expedient manner, the shielding element generally forms for this purpose a magnetically effective shield that is effective in this low frequency range.

In a preferred embodiment, the shielding foil is embodied from a suitable (ferro)-magnetic material and in particular an iron or nickel foil. Alternatively, said shielding foil is embodied as a coated carrier foil that is coated with suitable (ferro-)magnetic particles. Particles of this type are in particular by way of example iron particles. Generally, the shielding element therefore comprises a (ferro-)magnetic material for forming the magnetically effective shield, said magnetic material being either incorporated either in the form directly of foils or also in the form of (powder-)coated carrier foils. It is preferred that an additional magnetic shielding foil of this type is arranged in addition to the splayed-out bundle of wires so as to form the shielding element.

Overall, in an expedient further development, the two wire pairs are connected to one another jointly with the shielding element to form a stranded bundle. The two shielded wire pairs and the shielding element are therefore twisted in the longitudinal direction of the cable, as a consequence of which overall a sturdy cable construction is achieved. At the same time, the shielding element is consequently fixed and clamped between the wire pairs. In the case of this embodiment, the shielding element is therefore embodied in particular as a type of wound ribbon whose longitudinal edges extend along a helical line.

This stranded bundle is finally preferably then surrounded by a cable sheath that forms an outer sheath. In an expedient manner, the entire data cable is formed by means of this construction, in other words the stranded bundle comprises the two shielded wire pairs with the shielding element clamped between said wire pairs, wherein the stranded bundle is surrounded directly by the outer cable sheath. In particular, an additional outer shield that is conventionally arranged around a cable core comprising the wires is omitted. By means of individual pair shieldings, a shielding feature with respect to the outside is achieved that is sufficient for the intended area of application in particular in the automotive industry. By virtue of omitting an outer shield of this type, which is usually a braided arrangement, both the amount of (copper) material used is reduced and consequently the weight is also reduced. This is of particular advantage especially in the case of automotive applications on the one hand with regard to costing aspects and on the other hand for reasons of the generally desired weight reduction.

In an advantageous manner, the wires of a respective wire pair extend over the entire cable length parallel with one another and are therefore not twisted with one another as is the case in conventional twisted-pair data cables. As a consequence, material and costs are reduced. In this case, the planar, ribbon-shaped shielding element forms a separating layer between the wire pairs.

Furthermore, it is preferred that the two wire pairs are always oriented parallel with one another, in other words a connecting line of the wires of one wire pair is parallel with the connecting line of the wires of the other wire pair. In contrast thereto, the connecting lines of the pairs in the case of a star-quad arrangement extend perpendicular with respect to one another.

The respective pair shielding of the wire pairs is preferably formed by means of a longitudinally extending pair foil. In contrast to the otherwise frequently usual spun pair shieldings, said pair shielding renders it possible to achieve a considerably simpler and more cost-effective production process since typically in the case of pair foils that extend in a longitudinal manner, in other words are folded in the longitudinal direction, it is possible to achieve a considerably higher process rate during production. The term 'longitudinally extending' is therefore understood generally to mean a longitudinally-folded shielding foil that is applied parallel with the individual wires and is laid around the wires in a longitudinally-extending manner and as a consequence a longitudinally-extending join or overlapping site is produced that extends parallel with the wires. The wires of a wire pair themselves preferably likewise extend in a parallel manner and twisted with one another.

Furthermore, it is provided in an expedient further development that a respective wire pair is formed as one piece and comprises a common wire insulation so that the spacing between the two wires of a wire pair therefore remains constant over the entire cable length. The embodiment of the one-piece wire pair corresponds in particular to the variant described in German published patent application DE 199 48 678 A1 that has a connecting piece between the individual wire insulations.

A data cable of this type is particularly used for transmitting a differential data signal with high transmission frequencies. The differential data signal is transmitted by way of a respective wire pair, in other words the signal is transmitted by way of one wire and the inverted signal is transmitted by way of the other wire of the wire pair. The difference between the two signal portions is evaluated.

In particular, data signals are transmitted in the GHz range, in other words at a frequency greater than 1 GHz and in particular greater than 5 GHz up to 10 GHz or also higher.

Data cables of this type are furthermore preferably used for transmission distances of a few meters, in particular in the range of up to 10 m or 20 m and especially in the motor vehicle industry. In the case of transmission distances of this type, a reliable transmission in the GHz range that has a sufficiently high ACR value with low costs is ensured with the features described here. The ACR value is in particular above 10.

With the above and other objects in view there is also provided, in accordance with the invention, a method for producing a data cable of the foregoing type. The advantages achieved with respect to the data cable and preferred embodiments are also similarly to be transferred to the method.

Other features which are considered as characteristic for the invention are set forth in the appended claims.

Although the invention is illustrated and described herein as embodied in a data cable, and method for producing a data cable, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
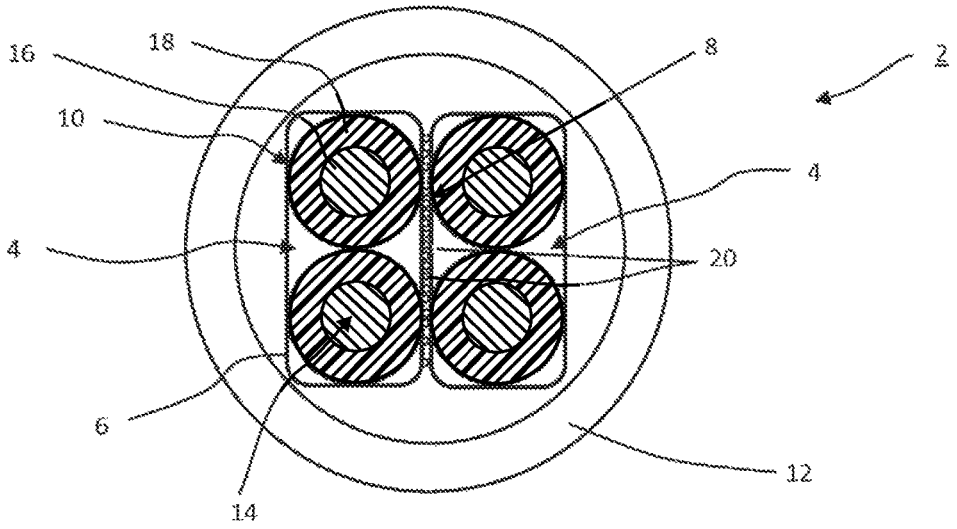
FIG. 1 is an end view of a section through a data cable.

Referring now to the figures of the drawing in detail and first, particularly, to FIG. 1 thereof, there is shown a data cable 2 which comprises and is in particular finally formed by means of two shielded wire pairs 4, or core pairs 4, that are surrounded in each case by a pair shielding 6. A further shielding element 8 is arranged between the wire pairs 4. This shielding element is arranged in a separating plane between the two wire pairs 4 and is clamped between said pairs. The shielding element 8 extends parallel within this separating plane and in particular over the entire length (when viewed in the cross-section) of a respective wire pair 4. The shielding element therefore comprises a length of approximately double the diameter of a respective wire 14.

The wire pairs 4 together with the shielding element 8 form a stranded bundle 10, in other words they are twisted with one another in the longitudinal direction of the data cable 2. This entire stranded bundle 10 is finally surrounded by an outer cable sheath 12 that is embodied from a suitable insulating material.

A respective wire pair 4 comprises two wires 14 that are formed in each case from a central conductor 16 and a wire insulation 18. A suitable insulating material that is suitable for transmitting high frequency data signals is selected for the wire insulation 18. The entire data cable 2 typically comprises an outer diameter D that lies in the range of a few millimeters, by way of example in the range between 4 and 8 mm.

Fundamentally, it is also possible to combine multiple data constructions of this type, as are illustrated in FIG. 1, to form one complete cable. It is also possible to integrate a plurality of the described cable bundles, in other words without the outer cable sheath 12, into a complete cable construction. In so doing, it is however of advantage if the respective cable bundle 10 is still surrounded by a shielding arrangement.

However, the cable construction finally illustrated in FIG. 1 is preferred for the data cable 2. A suitable plug connector, in particular a so-called HSD plug connector, is usually arranged at one end of the illustrated data cable 2 and in particular at both ends. A plug connector of this type comprises 4 contacts by way of which the individual wires 14 are contacted and in addition a ground contact, and the shielding element 8 makes contact with said ground contact. Conventional types of plug connectors as are used currently in the automotive industry in combination with star-quads can fundamentally still be used.

Figure 2:
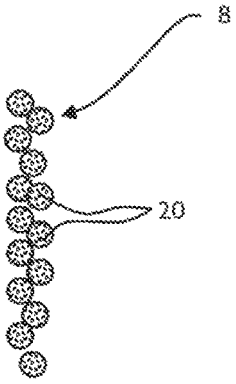
FIG. 2 is a section taken through a first embodiment of a shielding element.

The shielding element 8 is embodied—as is evident in FIG. 2—in a preferred first variant from a multiplicity of individual wires 20. The individual wires are in particular copper wires. In order to produce the shielding element 8, a conventional copper stranded wire or any other conductor bundle is used in an expedient manner, wherein the single individual wires 20 are splayed out so that the planar shielding element 8 as illustrated in the cross-section in FIG. 2 is formed. The individual wires 20 are arranged in a few layers extending adjacent to one another. Said individual wires therefore form in this respect a wire bundle that has been somewhat pressed flat. This bundle can be contacted in a particularly simple manner at one end on the plug connector by the ground contact. For this purpose, the individual wires 20 are brought back together and contacted.

Figure 3:
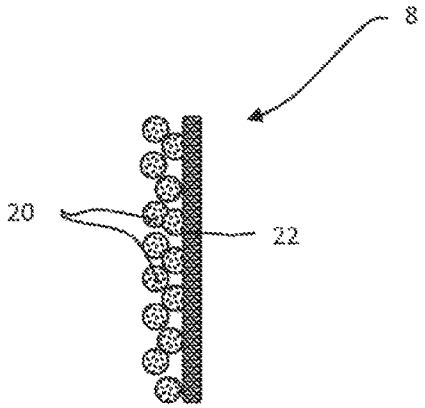
FIG. 3 is a section taken through a second embodiment of the shielding element.

In accordance with a second embodiment illustrated in FIG. 3, this wire bundle comprising the individual wires 20 is supplemented by a shielding foil 22 that comprises in particular a magnetic shielding effect. The shielding foil 22 is formed for this purpose from a material that has a magnetic shielding effect, in particular from a ferro-magnetic material. It is preferred that the shielding foil 22 is a metal foil, by way of example a nickel foil or an iron foil.

Figure 4:
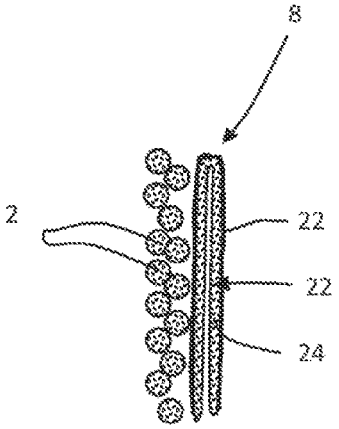
FIG. 4 is a section taken through a third embodiment of the shielding element.

As an alternative to this metal foil, the shielding foil 22 in accordance with FIG. 4 is embodied in a multi-layer manner and comprises a carrier foil 24 having a coating 26 that is applied thereto. The coating 26 can be a vapor-deposited suitable layer of a ferro-magnetic material or also a layer of powder particles of a suitable material. In particular, said material is an electrically conductive material so that it is ensured by way of the coating that an electrically conductive contact is also made with the individual wires 20 and the two pair shieldings 6. The carrier foil 24 can be provided on both faces with the coating 26. As alternative thereto, said carrier foil is only provided on one face with the coating 26, as is illustrated in FIG. 4. In this case, the carrier foil 24 is folded in particular once in the longitudinal direction so that the electrically conductive coating 26 is on both outer faces.

Figure 5:
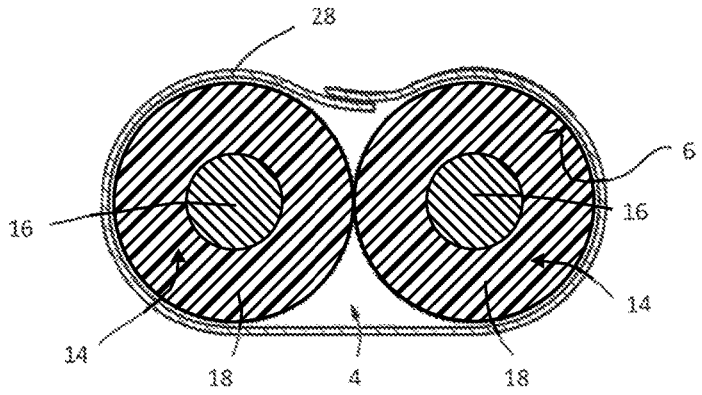
FIG. 5 is a section showing a wire pair that is surrounded by a longitudinally-folded pair foil.

Finally, the illustration in accordance with FIG. 5 once again shows the construction of the shielded wire pair 4. It is particularly evident that the pair shielding 6 is formed by means of a longitudinally-folded pair foil 28. Said pair foil is laid around the two wires 14 and comprises an overlap that extends parallel with the wires 14. The pair foil 28 is usually a metallized synthetic material carrier foil. The metallized face is preferably facing outwards.

The data cable 2 described in this case is made available in particular as a cable that is pre-assembled with a plug connector and used in the automotive industry. It is thus installed in the final state in the motor vehicle. It is suitable for transmitting data signals up to in the GHz range. In particular, the LVDS standard (low voltage differential signaling) is used for data transmission in particular in the automotive industry.

Overall, this data cable 2 is comparatively cost-effective to produce. In comparison to conventional star-quads, the production process is simplified as a result of using the pair shielding 6 since fewer demands are placed on precisely positioning the single wires 14 in a highly precise manner with respect to each other. The production process is also more cost-effective in comparison to conventional high speed data cables that are provided with a spun pair shielding since in the present case a longitudinally-folded pair foil 28 is used. A further particular advantage is produced by virtue of the fact that an outer shield is omitted, as a consequence of which overall in comparison to conventional data cables the amount of copper required is less and thus the costs are reduced. Simultaneously, this also produces a reduction in weight which is important for the automotive industry. Finally, by virtue of the cable construction, the amount of space required is identical to that in the case of a star-quad, as is nowadays already usual in the automotive industry. The data cable 2 can therefore be used as a replacement for star-quad constructions previously used.

Figure 6:
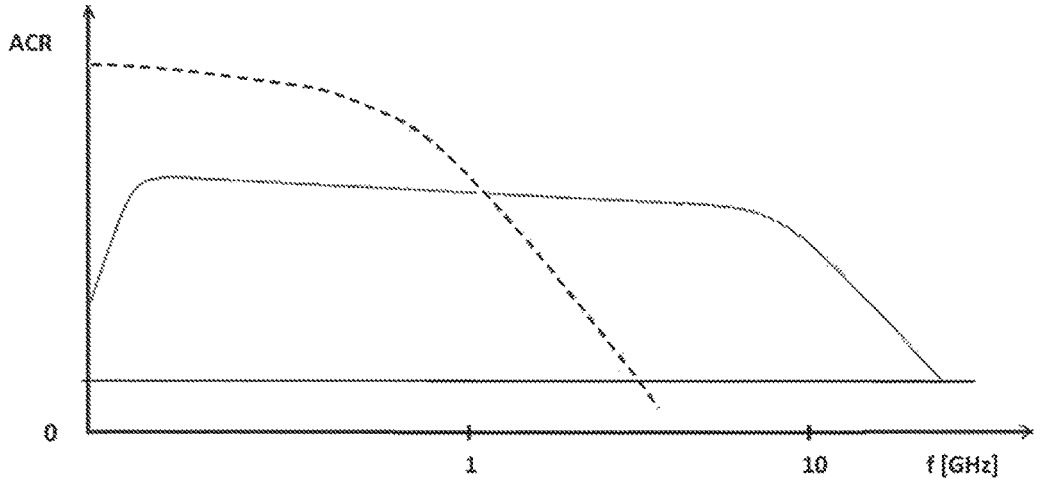
FIG. 6 illustrates a schematic comparative view of the progression of the ACR ratio with respect to the transmission frequency for a conventional star-quad and for a data cable in accordance with the invention.

Higher data rates in comparison to a star-quad arrangement and connection can be achieved using the data cable 2 described here. This is explained with reference to FIG. 6. This is demonstrated by the progression of the ACR ratio of attenuation to interference (in particular caused by near-end crosstalk) with respect to the frequency f of the data signal. The broken line indicates the progression in the case of a star-quad arrangement and the uninterrupted line indicates the progression in the case of a data cable 2 in accordance with the invention. As is evident in the illustration, although the ACR ratio in the case of low frequencies is greater in the case of the star-quad, the ratio greatly reduces in the case of higher frequencies in the GHz range. In contrast, the ACR ratio in the case of the data cable 2 in accordance with the invention over a large frequency range also in the GHz range up to in the range of approx. 10 GHz is sufficiently high for a reliable signal transmission. The lower line extending in a transverse manner represents a limit value for a reliable signal transmission. This limit is by way of example 5 to 10.

The following is a summary list of reference numerals and the corresponding structure used in the above description of the invention:

2 Data cable
4 Wire pair
6 Pair shielding
8 Shielding element
10 Stranded bundle
12 Cable sheath
14 Wire
16 Conductor
18 Wire insulation
20 Individual wires
22 Shielding foil
24 Carrier foil
26 Coating
28 Pair foil

The invention claimed is:

1. A data cable, comprising:

two wire pairs each including two wires;

a pair shielding surrounding each of said two wire pairs;

a planar shielding element disposed between said wire pairs and not encompassing said wire pairs, said planar shielding element making contact with each said pair shielding; and said planar shielding element is formed of a plurality of single individual wires extending adjacent to one another, said individual wires are a splayed-out stranded conductor.

2. The data cable according to claim 1, wherein said planar shielding element comprises a shielding foil.

3. The data cable according to claim 2, wherein said shielding foil comprises a ferro-magnetic material.

4. The data cable according to claim 2, wherein said shielding foil is a nickel foil or a coated carrier foil provided with a layer of powder particles.

5. The data cable according to claim 1, wherein said two wire pairs together with said shielding element form a stranded bundle.

6. The data cable according to claim 1, wherein said wire pairs contain wires that are not twisted wires.

7. The data cable according to claim 1, wherein said pair shielding is formed of a longitudinally extending pair foil.

8. The data cable according to claim 1, wherein each respective wire pair is a one piece construction with said two wires surrounded by a common wire insulation.

9. A method of transmitting signals, the method comprising:

providing a data cable according to claim 1; and transmitting signals in the form of a differential data signal in a respective wire pair.

10. The method according to claim 9, which comprises transmitting the signals at a data rate greater than one gigahertz.

11. The method according to claim 10, which comprises transmitting the signals at a data rate greater than 5 GHz.

12. A method for producing a data cable, the method comprising:

providing two shielded wire pairs each having two wire pairs and a respective pair shielding;

inserting a planar shielding element that does not surround the wire pairs between the two shielded wire pairs; and forming the data cable in a continuous process, and wherein the planar shielding element comprises a stranded conductor that is splayed-out and extends parallel with the wire pairs.

13. The method according to claim 12, which comprises forming the data cable according to claim 1.

14. The method according to claim 12, which comprises forming the data cable in a continuous process, and wherein the planar shielding element is a shielding foil that extends parallel with the wire pairs.

15. The method according to claim 12, which comprises the respective pair shielding forming a longitudinally extending pair foil.

16. The method according to claim 12, where the data cable is provided exactly two wire pairs.

17. The method according to claim 12, which comprises each wire pair defining a longitudinal side, the two longitudinal sides facing each other and the planar shielding element being disposed between the two longitudinal sides.

18. The method according to claim 12, which comprises the two wire pairs together with the planar shielding element forming a stranded bundle.

* * * * *